US009605577B2

(12) United States Patent
Navathe et al.

(10) Patent No.: US 9,605,577 B2
(45) Date of Patent: Mar. 28, 2017

(54) EXHAUST PASSAGE

(75) Inventors: Sudhakar Navathe, Canton, MI (US); John Roberts, Toledo, OH (US); Joel John Beltramo, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 311 days.

(21) Appl. No.: 12/837,202

(22) Filed: Jul. 15, 2010

(65) Prior Publication Data

US 2012/0011837 A1 Jan. 19, 2012

(51) Int. Cl.

| | |
|---|---|
| ***F01N 3/00*** | (2006.01) |
| ***F01N 3/28*** | (2006.01) |
| ***F01N 13/18*** | (2010.01) |

(52) U.S. Cl.

CPC ..... *F01N 3/2892* (2013.01); *F01N 13/1872* (2013.01); *F01N 2240/20* (2013.01); *F01N 2470/06* (2013.01); *F01N 2470/12* (2013.01)

(58) Field of Classification Search

CPC ..... F01N 13/1872; F01N 3/2892; F01N 2240/20; F01N 2470/06; F01N 2470/12

USPC ..... 60/288, 316, 317, 324; 366/338, 181.5, 366/64

See application file for complete search history.

(56) References Cited

U.S. PATENT DOCUMENTS

| | | | | |
|---|---|---|---|---|
| 860,259 | A | 7/1907 | Smith | |
| 1,242,975 | A | 10/1917 | Planche | |
| 2,358,386 | A | 9/1944 | Doll | |
| 3,506,475 | A | 4/1970 | MacDonnell | |
| 4,106,287 | A | 8/1978 | Auclair et al. | |
| 4,255,121 | A | 3/1981 | Sugimoto | |
| 4,370,304 | A | 1/1983 | Hendriks et al. | |
| 4,374,026 | A | 2/1983 | Greutert | |
| 5,522,218 | A | 6/1996 | Lane et al. | |
| 6,449,947 | B1 | 9/2002 | Liu et al. | |
| 6,516,610 | B2 | 2/2003 | Hodgson | |
| 6,539,708 | B1 | 4/2003 | Hofmann et al. | |
| 6,722,124 | B2 | 4/2004 | Pawson et al. | |
| 7,059,118 | B2 * | 6/2006 | Ripper et al. | 60/286 |
| 7,328,572 | B2 | 2/2008 | McKinley et al. | |
| 7,396,208 | B1 | 7/2008 | Hussain | |
| 7,814,745 | B2 * | 10/2010 | Levin et al. | 60/286 |
| 2002/0108368 | A1 | 8/2002 | Hodgson | |
| 2003/0079467 | A1 | 5/2003 | Liu et al. | |
| 2004/0050037 | A1 | 3/2004 | Betta et al. | |
| 2004/0237511 | A1 | 12/2004 | Ripper et al. | |
| 2005/0172615 | A1 * | 8/2005 | Mahr | 60/286 |
| 2007/0036694 | A1 * | 2/2007 | Nishioka et al. | 422/168 |
| 2007/0204751 | A1 | 9/2007 | Wirth et al. | |

(Continued)

FOREIGN PATENT DOCUMENTS

| | | |
|---|---|---|
| DE | 198 06 265 C1 | 7/1999 |
| EP | 0 894 523 B1 | 2/1999 |

(Continued)

*Primary Examiner* — Thomas Denion
*Assistant Examiner* — Matthew T Largi
(74) *Attorney, Agent, or Firm* — Julia Voutyras; McCoy Russell LLP

(57) ABSTRACT

An exhaust system comprises a conical shell having an indentation traversing the exhaust passage in a coiled path so as to impart mixing on an engine exhaust gas flowing through an inner passage defined by the conical shell. The indentation may be formed into the conical shell via a stamping process.

20 Claims, 3 Drawing Sheets

(56) References Cited

U.S. PATENT DOCUMENTS

| | | | | |
|---|---|---|---|---|
| 2007/0245718 | A1* | 10/2007 | Cheng et al. | 60/286 |
| 2008/0184700 | A1 | 8/2008 | Harrer | |
| 2008/0295497 | A1* | 12/2008 | Kornherr et al. | 60/286 |
| 2009/0044524 | A1 | 2/2009 | Fujino | |
| 2009/0266064 | A1* | 10/2009 | Zheng et al. | 60/317 |
| 2010/0005790 | A1 | 1/2010 | Zhang | |
| 2011/0162353 | A1* | 7/2011 | Vanvolsem et al. | 60/299 |

FOREIGN PATENT DOCUMENTS

| | | | |
|---|---|---|---|
| EP | 1 712 756 | A1 | 10/2006 |
| GB | 2 385 545 | A | 8/2003 |
| WO | WO 0012879 | A1 * | 3/2000 |
| WO | 2006123511 | A1 | 11/2006 |

* cited by examiner

EXHAUST PASSAGE

TECHNICAL FIELD

The present application relates to an exhaust system.

BACKGROUND AND SUMMARY

A technology such as Selective Catalyst Reduction (SCR) may be utilized for NOx reduction and to achieve diesel emissions requirements. In one approach, aqueous urea is sprayed into the exhaust gas stream which subsequently reacts with NOx on the surface of an SCR catalyst, resulting in reduction of engine-out NOx emissions. For improved NOx reduction under some conditions, the liquid urea sprayed into the diesel exhaust is typically atomized and mixed before it reaches the catalyst substrate.

In one mixing approach, a two-mixer system may be utilized to provide such mixing, where a first element (e.g., an atomizer) of the system redirects the exhaust flow and catches the urea spray for atomization, and a second element (e.g., a twist mixer) aids in mixing the exhaust flow. As an example, the atomizer may include several (e.g., nine) louvers, and the twist mixer may include a helical mixing element which is welded onto a center rod.

The inventors of the present application have recognized a problem in such previous solutions. First, the atomizer is typically stamped and processed as a round element to fit into the exhaust system, and the numerous louvers add to the weight and cost of the two-mixer system. Second, the mixing element of the twist mixer typically requires separate fabrication. Further, traditional twist mixers may be welding-intensive, in that the center rod and a stiffener bar are welded at the outlet, and the whole assembly is then welded to a conical shell.

Accordingly, in one example, some of the above issues may be addressed by an exhaust passage comprising an exterior wall having an inwardly-protruding indentation traversing at least once around the exhaust passage in a helical path. The exterior wall then defines an interior passage configured to receive engine exhaust gas and direct the engine exhaust gas via the inwardly-protruding indentation. In this way, by having the indentation structure configured within the wall of the passage, separate elements traditionally welded into mixing devices may be eliminated, such as a mixing element, center rod, and stiffener bar, if desired. The exhaust passage may further include an atomizer of a partial disc shape positioned in the exhaust passage upstream of the portion comprising the inwardly-protruding indentation, which is configured to redirect exhaust flow and catch a fluid spray for atomization. The partial disc shape eliminates the overall circular design (e.g., with a circular perimeter) of traditional atomizers, and may utilize fewer louvers than traditional atomizers, thus reducing the weight and cost of the system. As such, the exhaust passage can achieve good atomization and mixing, at a lower manufacturing cost.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Embodiments of an exhaust passage are disclosed herein. Such an exhaust passage may be utilized for NOx reduction in an exhaust stream, as described in more detail hereafter. Various of the figures are drawn approximately to scale, including FIGS. 2-5.

Figure 1:
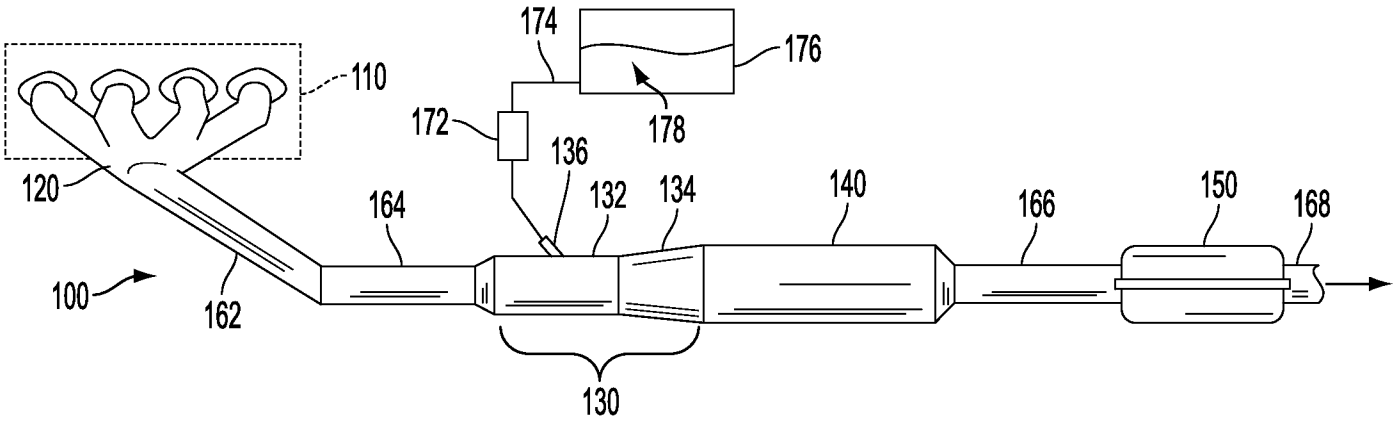
FIG. 1 illustrates an exhaust system for receiving engine exhaust gas.

FIG. 1 illustrates an exhaust system 100 for transporting exhaust gases produced by internal combustion engine 110. As one non-limiting example, engine 110 includes a diesel engine that produces a mechanical output by combusting a mixture of air and diesel fuel. Alternatively, engine 110 may include other types of engines such as gasoline burning engines, among others.

Exhaust system 100 may include one or more of the following: an exhaust manifold 120 for receiving exhaust gases produced by one or more cylinders of engine 110, a mixing region 130 arranged downstream of exhaust manifold 120 for receiving a liquid reductant, a selective catalytic reductant (SCR) catalyst 140 arranged downstream of the mixing region 130, and a noise suppression device 150 arranged downstream of catalyst 140. Additionally, exhaust system 100 may include a plurality of exhaust pipes or passages for fluidically coupling the various exhaust system components. For example, as illustrated by FIG. 1, exhaust manifold 120 may be fluidically coupled to mixing region 130 by one or more of exhaust passages 162 and 164. Catalyst 140 may be fluidically coupled to noise suppression device 150 by exhaust passage 166. Finally, exhaust gases may be permitted to flow from noise suppression device 150 to the surrounding environment via exhaust passage 168. Note that while not illustrated by FIG. 1, exhaust system 100 may include a particulate filter and/or diesel oxidation catalyst arranged upstream or downstream of catalyst 140. Furthermore, it should be appreciated that exhaust system 100 may include two or more catalysts.

In some embodiments, mixing region 130 can include a greater cross-sectional area or flow area than upstream exhaust passage 164. Mixing region 130 may include a first portion 132 and a second portion 134. The first portion 132 of mixing region 130 may include an injector 136 for selectively injecting a liquid into the exhaust system. As one non-limiting example, the liquid injected by injector 136 may include a liquid reductant 178 such as ammonia or urea. The liquid reductant 178 may be supplied to injector 136 through conduit 174 from a storage tank 176 via an intermediate pump 172. The second portion 134 of mixing region 130 may be configured to accommodate a change in cross-sectional area or flow area between the first portion 132 and the catalyst 140. Note that catalyst 140 can include any suitable catalyst for reducing NOx or other products of combustion resulting from the combustion of fuel by engine 110.

Note that with regards to vehicle applications, exhaust system 100 may be arranged on the underside of the vehicle chassis. Additionally, it should be appreciated that the exhaust passage may include one or more bends or curves to accommodate a particular vehicle arrangement. Further still, it should be appreciated that in some embodiments, exhaust system 100 may include additional components not illustrated in FIG. 1 and/or may omit components described herein.

Figure 2:
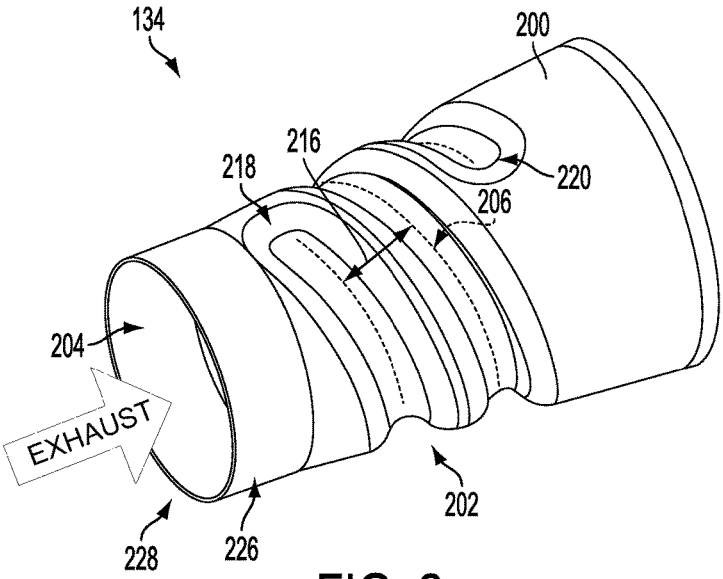
FIG. 2 illustrates an isometric view of a portion of the exhaust system of FIG. 1 in greater detail and drawn approximately to scale.
Figure 3:
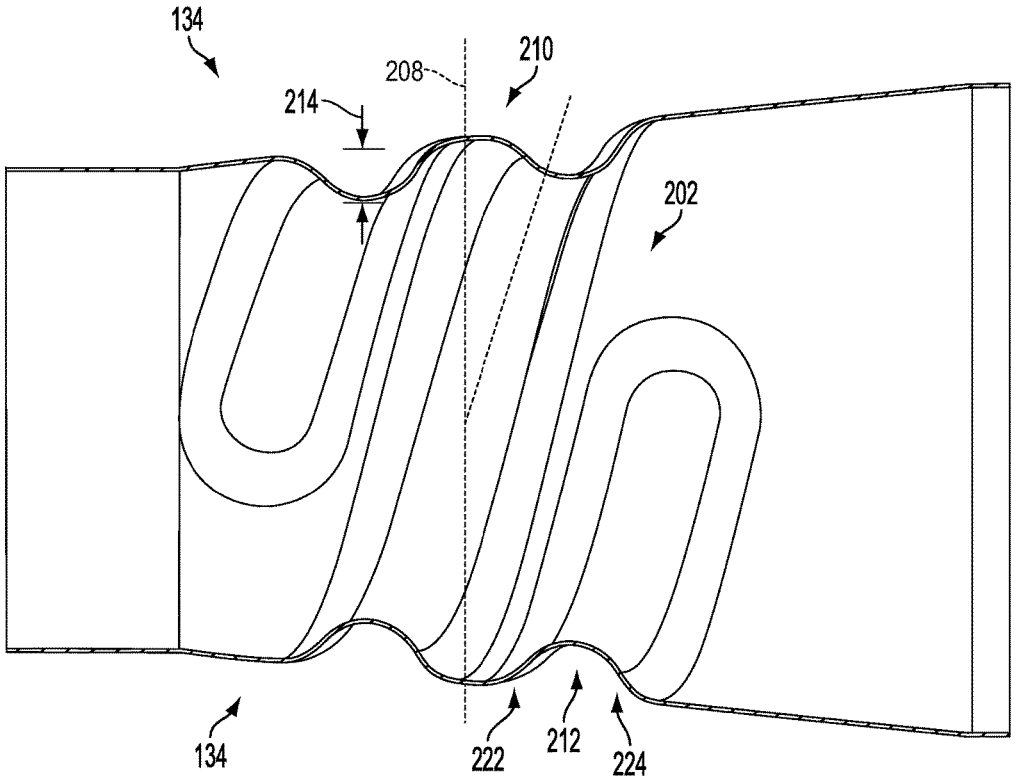
FIG. 3 illustrates a side view of the portion of the exhaust system of FIG. 2 drawn approximately to scale.

FIGS. 2 and 3 illustrate a portion of the exhaust passage for receiving engine exhaust gas, namely the second portion 134 of mixing region 130. At least a portion of second portion 134 comprises an exterior wall 200 having an inwardly-protruding indentation 202. As described above, the exhaust gas leaving the engine may first pass through a first portion such as first portion 132, wherein a fluid such as a liquid reductant (e.g., ammonia, urea, etc.) is injected into the exhaust system. As such, inwardly-protruding indentation 202 of second portion 134 then aids in further mixing of the engine exhaust gas before the engine exhaust gas reaches SCR catalyst 140. In this way, by better mixing the engine exhaust gas, performance of SCR catalyst 140 may be further enhanced, and thus, NOx may be further reduced.

Exterior wall 200 defines an interior passage 204 configured to receive the engine exhaust gas. As introduced above, inwardly-protruding indentation 202 is configured to redirect the engine exhaust gas, so as to promote mixing. Inwardly-protruding indentation 202 may be configured in a variety of ways. For example, inwardly-protruding indentation 202 may traverse at least once around the exhaust passage in a path 206. As an example, path 206 may be a coiled path angled with respect to a cross-section 208 of second portion 134, as indicated at 210. For example, path 206 may be a helical path around the perimeter of the exhaust passage pipe. Further, in some embodiments, such a helical path may be substantially left-handed so as to promote mixing of the engine exhaust gas in a downstream direction toward SCR catalyst 140. It should be appreciated that inwardly-protruding indentation 202 which traverses the exhaust passage at least once may in some embodiments traverse the exhaust passage more than once. As an example, in some embodiments, inwardly-protruding indentation 202 may traverse the exhaust passage at least twice. As another example, inwardly-protruding indentation 202 may traverse the exhaust passage several times (e.g., five times). Further, inwardly-protruding indentation 202 may be substantially continuous in some embodiments. However, in some embodiments, inwardly-protruding indentation 202 may be a combination of a plurality of separate indentations that together form the path (e.g., the helical path).

Inwardly-protruding indentation 202 may have a variety of shapes and structure. As an example, inwardly-protruding indentation 202 may be a trough depressed into exterior wall 200 and wrapping around second portion 134. Such a trough may have, for example, a semi-circle cross-section, as indicated at 212. However, it should be appreciated that a semicircular cross-section is just one example shape of many suitable shapes for inwardly-protruding indentation 202. For example, in some embodiments, inwardly-protruding indentation 202 may have a shape corresponding to a different arc. As yet another example, in some embodiments, inwardly-protruding indentation 202 may have a geometric shape, such that the cross-section is substantially inverted-trapezoidal, for example.

Due to the inwardly-protruding indentation 202, interior passage 204 may be referred to as having internally protruding screw-like threads, where the "threads" created by inwardly-protruding indentation 202 redirect incoming engine exhaust gas by imparting rotational motion about the axis of the exhaust passage, thus promoting mixing. As an example, engine exhaust gas may enter the second portion 134 with a first amount of rotational motion, which may be relatively little or none; however, upon impacting inwardly-protruding indentation 202, additional rotational motion may be imparted into the flow. In this way, second portion 134 may be configured as a twist mixing device. As described above, the cross-sectional shape of inwardly-protruding indentation 202 may be a variety of shapes. For example, the "threadform" of the "thread" may be a variety of shapes, such as an arc, square, triangle, trapezoid, etc.

Inwardly-protruding indentation 202 may be further parameterized as follows. The depth of the protrusion into the interior of the exhaust passage (e.g., thread depth 214) may be selected to be less than approximately 20% of the diameter of the exhaust passage at which the thread is located. In this way, reduced backpressure may be provided. Also, the relative width of the thread to the depth of the thread may be selected to be substantially a ratio of within about 10% of 3:1. Further, the distance from the trough of one thread to the next (e.g., thread pitch 216) may be approximately 40% (+−10%) of the diameter of the exhaust passage at which the thread is located. The diameter in between the largest diameter of a thread and the smallest diameter of the thread (pitch diameter) may be approximately 85% (+−10%) of the largest diameter of the thread. Further still, in some embodiments, an integer number of threads may be provided, such that the beginning portion 218 and the ending portion 220 of inwardly-protruding indentation 202 occur at substantially a same location on second portion 134 with respect to an axis of second portion 134.

Moreover, in addition to the shape of inwardly-protruding indentation 202 as indicated at 212, rounded transitions such as indicated at 222 and 224 may be utilized to smoothly transition the surface of the exterior wall 200 to inwardly-protruding indentation 202. Further, the beginning portion 218 and the ending portion 220 of inwardly-protruding indentation 202 may be tapered so as to smoothly transition the surface of the exterior wall 200 to inwardly-protruding indentation 202. Accordingly, such smooth transitions allow for an interior surface of interior passage 204 to likewise smoothly transition into inwardly-protruding indentation 202.

Further, second portion 134 may be substantially tapered inward in an upstream direction. This may include the exterior walls 200 of the second portion 134 tapering inward so that the cross-sectional area of the passage becomes larger in the direction of exhaust flow. Said another way, second portion 134 may be tapered such that the diameter of the passage becomes larger in the direction of exhaust flow. As an example, in some embodiments, second portion 134 may be a conical shell. In such a case, exterior wall 200 has a given thickness so as to form the shell. As such, inwardly-protruding indentation 202 protruding into exterior wall 200 protrudes into the shell, and thus redirects air of the interior passage 204. As an example, inwardly-protruding indentation 202 may be stamped into the conical shell (e.g., by stamping flutes into the conical shell). Further, the conical shell can be broken up into a first portion and a second portion (e.g., a lower piece and an upper piece) to ease the manufacturing and assembly process.

Unlike traditional twist mixers which require fabrication of a separate mixing element which is then welded on to a center rod and a stiffener bar at the outlet, wherein the whole assembly is then welded to the conical shell, second portion 134 comprises a conical shell with inwardly-protruding indentation 202. In this way, second portion 134 as described herein allows for the separate mixing element of traditional twist mixers to be eliminated, as well as the center rod, stiffener bar and associated welding, if desired.

Figure 4:
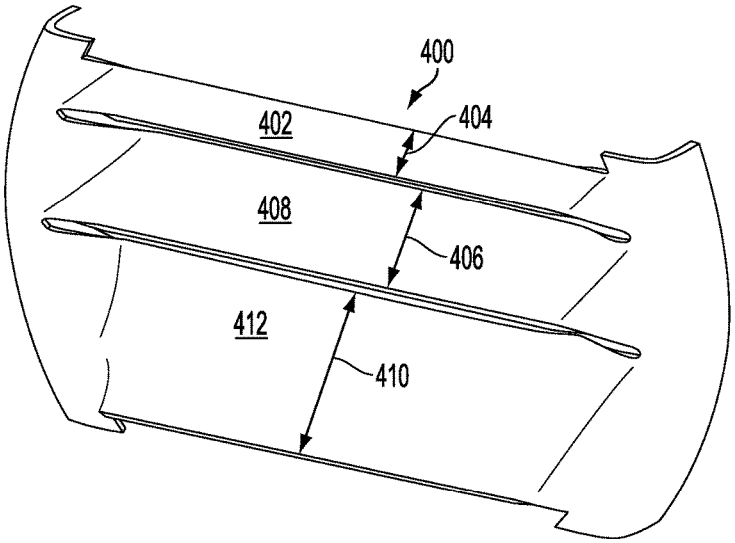
FIG. 4 illustrates an isometric view of another portion of the exhaust system of FIG. 1 in greater detail and drawn approximately to scale.
Figure 5:
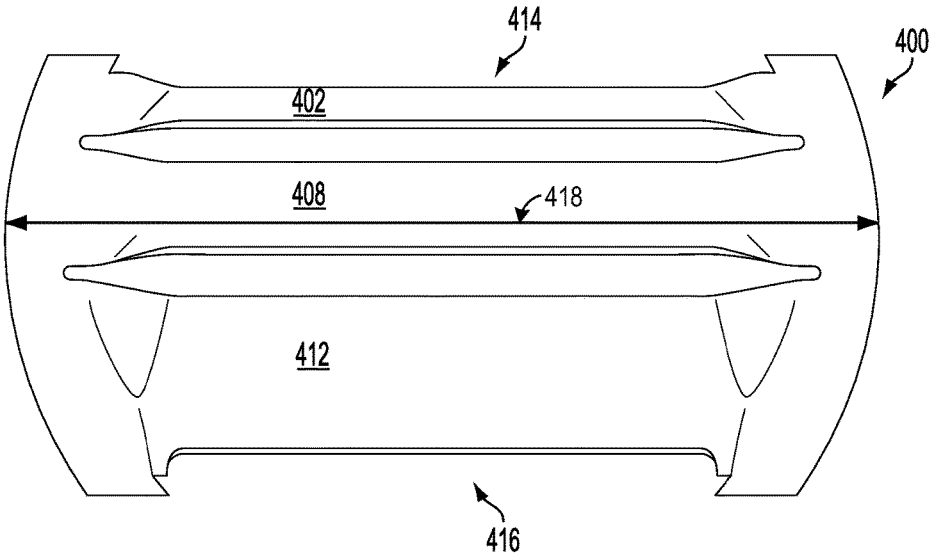
FIG. 5 illustrates a front view of the portion of the exhaust system of FIG. 4 drawn approximately to scale.

In addition to mixing the engine exhaust gas before it reaches the catalyst, it may be further beneficial to atomize the exhaust prior to such mixing. As such, mixing region 130 may further include an atomizer positioned in the exhaust passage upstream of inwardly-protruding indentation 202 and downstream of injector 136. FIGS. 4 and 5 illustrate an example of such an atomizer 400 having a non-circular perimeter. Atomizer 400 may comprise louvers configured to redirect the engine exhaust gas and catch a fluid spray, for example from injector 136, for atomization. In one embodiment, atomizer 400 comprises exactly three louvers, as depicted in FIGS. 4 and 5.

In some embodiments, each of the louvers may be configured substantially differently. For example, each of the three louvers may have a different depth. In the depicted example, a first louver 402 of the three louvers may have a smaller depth 404 than a depth 406 of an adjacent second louver 408. Likewise, second louver 408 may have a smaller depth 406 than a depth 410 of adjacent third louver 412. As another example, each of the three louvers may be optionally positioned at a different angle. As yet another example, the three louvers may be nonuniformly spaced apart.

As further depicted, atomizer 400 may have a partial disc shape. As such, when positioned in the exhaust passage upstream of the inwardly-protruding indentation 202, (e.g., upstream of the twist mixing device comprising the trough), the partial disc shape defines a free region 414 above the atomizer and a free region 416 below the atomizer, through which the engine exhaust gas can flow unobstructedly.

Atomizer 400 may be positioned within mixing region 130 upstream of inwardly-protruding indentation 202, for example, adjacent to a narrower end of the conical shell. As such, a width 418 of atomizer 400 may be substantially the same as a diameter of the narrower end of the conical shell, such that exhaust gas may pass through atomizer 400 into interior passage 204. In some embodiments, atomizer 400 may be positioned within second portion 134, such as within region 226 as indicated in FIG. 2. However, in some embodiments, atomizer 400 may be positioned within first portion 132 of mixing region 130, so as to be located directly adjacent to the narrower end of the conical shell, such as within region 228.

Thus, whereas traditional atomizers typically have nine louvers, and are stamped and processed as a round element to fit into the exhaust system, atomizer 400 of a partial disc shape uses three louvers. In this way, by eliminating the circular design and additional louvers, the weight of atomizer 400 is reduced in comparison to traditional atomizers, and thus, the cost of the system may also be reduced.

Thus, the partial disc shape allows for atomization to still be achieved, yet with a reduced impact to weight and cost. This is because the configuration allows for louvers to be positioned in the region where engine exhaust gas typically receives the majority of the fluid spray. In this way, the louvers can then redirect a majority of the engine exhaust gas, whereas a minority of the engine exhaust gas may flow unobstructedly through the free regions 414 and 416 above and below the atomizer respectively. This minority amount of the engine exhaust gas flowing unobstructedly through the free regions 414 and 416 is offset by the cost and weight savings achieved by atomizer 400. Further, exhaust back pressure effects can be reduced.

In this way, exhaust system 100 can achieve good atomization and mixing, while allowing for manufacturing costs and time to be significantly reduced. For example, in comparison to traditional exhaust systems, exhaust system 100 comprising atomizer 400 and a second portion 134 with inwardly-protruding indentation 202 (e.g., a twist mixing device) may reduce process time and assembly time (e.g., by approximately 10% and 20%, respectively) in comparison to that of traditional mixing devices. Further, exhaust system 100 may significantly reduce weight, cost and tooling (e.g., by approximately 50%) in comparison to that of traditional mixing devices.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. An exhaust passage for receiving engine exhaust gas, the exhaust passage having a mixing region comprising a first portion upstream of a second portion, the second portion comprising an exterior wall having a continuous helical trough depressed onto the exterior wall and wrapping around the second portion, the trough formed as an inwardly-protruding indentation traversing at least once around the exhaust passage in a coiled path angled with respect to a cross-section of the exhaust passage, the exterior wall defining an interior passage configured to receive the engine exhaust gas and redirect the engine exhaust gas via the inwardly-protruding indentation, the inwardly-protruding indentation comprising an inner surface facing the interior passage and an outer surface opposite the inner surface, the inwardly-protruding indentation further comprising a first terminal end where exhaust gas first impinges on the inner surface and a second terminal end where exhaust gas lastly impinges on the inner surface, each of the first terminal end and the second terminal end located on a same side of the exhaust passage and aligned along a same axis of the mixing region, and the mixing region further comprising a rounded transition between a surface of the exterior wall upstream of the trough and the first terminal end of the inwardly-protruding indentation, the rounded transition extending along an entirety of the trough from the first terminal end to the second terminal end.

2. The exhaust passage of claim 1, wherein the inwardly-protruding indentation traverses at least once around the exhaust passage in a continuous manner and has a depth into an interior of the exhaust passage of less than 20% of a diameter of the exhaust passage.

3. The exhaust passage of claim 2, wherein the rounded transition is also between the surface of the exterior wall and the second terminal end, wherein the coiled path traverses at least once around the exhaust passage in a left-handed direction.

4. The exhaust passage of claim 3, wherein the second portion of the exhaust passage is tapered inward in an upstream direction, wherein the inwardly-protruding indentation is positioned at a portion of the exhaust passage comprising a conical shell.

5. The exhaust passage of claim 4, wherein the first portion of the exhaust passage has a constant cross-sectional diameter and the second portion of the exhaust passage increases in cross-sectional diameter in a direction of exhaust flow, and wherein the inwardly-protruding indentation has a depth of protrusion into an interior of the exhaust passage that is closer to a central axis of exhaust flow than an interior of the first portion of the exhaust passage for at least one traversal of the inwardly-protruding indentation around the exhaust passage.

6. The exhaust passage of claim 1, further comprising an atomizer positioned in the first portion of the exhaust passage upstream of the inwardly-protruding indentation, the atomizer comprising exactly three louvers configured to redirect the engine exhaust gas and catch a fluid spray for atomization.

7. The exhaust passage of claim 6, wherein the atomizer is positioned within an interior passage of the exhaust passage so as to define a free region above the atomizer and a free region below the atomizer through which the engine exhaust gas can flow unobstructedly.

8. The exhaust passage of claim 6, wherein each of the three louvers has a different depth and is positioned at a different angle with respect to one another.

9. The exhaust passage of claim 6, wherein a first louver of the three louvers has a smaller depth than an adjacent second louver of the three louvers, and wherein the second louver has a smaller depth than an adjacent third louver of the three louvers.

10. The exhaust passage of claim 1, further comprising an injector positioned on a top of the exhaust passage upstream of the second portion and angled towards a bottom of the exhaust passage such that liquid injected by the injector is directed towards the bottom of the exhaust passage.

11. The exhaust passage of claim 1, wherein the inwardly-protruding indentation traverses exactly twice around the exhaust passage.

12. An exhaust system for an engine, comprising:

an exhaust passage tapered inward in an upstream direction, a portion of an exterior wall of the exhaust passage having an inwardly-protruding indentation traversing at least once around the exhaust passage in a coiled path angled with respect to a cross-section of the exhaust passage, the exterior wall defining an interior passage configured to receive engine exhaust gas and direct the engine exhaust gas via the inwardly-protruding indentation, the inwardly-protruding indentation creating a thread having a width parallel to a longitudinal axis of the exhaust passage and a depth perpendicular to the longitudinal axis, the width greater than the depth, the inwardly-protruding indentation including a cross-section defined by a first transition between a surface of the exterior wall and the inwardly-protruding indentation and a second transition between the surface of the exterior wall and the inwardly-protruding indentation, an entirety of the cross-section from the first transition to the second transition shaped as a semi-circle; and an atomizer having a non-circular perimeter positioned in the exhaust passage upstream of the portion comprising the inwardly-protruding indentation so as to define a free region of the exhaust passage above the atomizer and a free region of the exhaust passage below the atomizer through which the engine exhaust gas can flow unobstructedly.

13. The exhaust system of claim 12, wherein the inwardly-protruding indentation traverses at least once around the exhaust passage in a continuous manner.

14. The exhaust system of claim 12, wherein the portion of the exterior wall of the exhaust passage having the inwardly-protruding indentation is a conical shell.

15. The exhaust system of claim 12, wherein the atomizer comprises exactly three louvers configured to redirect the engine exhaust gas and catch a fluid spray for atomization.

16. The exhaust system of claim 15, wherein each of the three louvers has a different depth and is positioned at a different angle.

17. An exhaust system for an engine, comprising:

an exhaust passage comprising a twist mixing device, the twist mixing device comprising an entry passage having a constant cross-sectional diameter immediately upstream of a conical shell, an entirety of the conical shell tapered inward in an upstream direction and having a wall comprising a trough depressed into the wall, the trough having a semicircular cross-section and wrapping around the conical shell at least twice, the wall of the conical shell defining an interior passage for receiving engine exhaust gas and directing the engine exhaust gas via the trough, the exhaust passage further comprising rounded transitions between the wall and the trough, the trough having a depth of protrusion into an interior of the conical shell that is closer to a central axis of exhaust flow than an interior of the entry passage for at least one traversal of the trough around the conical shell; and an atomizer having a non-circular perimeter positioned in the exhaust passage upstream of the twist mixing device comprising the trough so as to create a free region of the exhaust passage above the atomizer and a free region of the exhaust passage below the atomizer through which the engine exhaust gas can flow unobstructedly, the atomizer further comprising exactly three louvers configured to redirect the engine exhaust gas and catch a fluid spray for atomization, each of the three louvers having a different depth.

18. The exhaust system of claim 17, wherein the wrapping of the trough is angled in a flow direction of the engine exhaust gas.

19. The exhaust system of claim 17, wherein the three louvers are nonuniformly spaced apart.

20. The exhaust system of claim 17, wherein the twist mixing device comprises a first portion and a second portion assembled to create the conical shell.

* * * * *